US005255954A

United States Patent [19]

Rogers

[11] Patent Number: 5,255,954

[45] Date of Patent: Oct. 26, 1993

[54] SUN SHADE UMBRELLA MOUNT FOR A CHAIR BACK

[76] Inventor: Bill L. Rogers, 412 E. Duncan, Jenks, Okla. 74037

[21] Appl. No.: 776,020

[22] Filed: Oct. 15, 1991

[51] Int. Cl.[5] ..... A47C 7/66

[52] U.S. Cl. ..... 297/184.16; 135/96; 297/184.16

[58] Field of Search ..... 297/184, 188, 191; 135/96

[56] References Cited

U.S. PATENT DOCUMENTS 3,845,985 11/1974 Behrend ..... 297/184
4,100,633 7/1978 Pintos ..... 297/184 X
4,781,411 11/1988 Kolb ..... 297/184
4,789,200 12/1988 Munguia ..... 297/184
5,096,257 3/1992 Clark ..... 297/184

*Primary Examiner*—Peter R. Brown
*Attorney, Agent, or Firm*—Robert K. Rhea

[57] ABSTRACT

A chair back connected umbrella support is formed by an open frame, vertically supporting an elongated sleeve slidably receiving the shank of an umbrella. The frame is removably supported by an inclined chair back by J-shaped hooks connected therewith and the umbrella shank receiving sleeve is disposed substantially vertically by a pair of tubes projecting laterally of the frame and nested by sockets connected with the chair back below the J-shaped hooks. A cam lever engaging the umbrella shank vertically adjustably supports the umbrella relative to the chair and the occupant therein.

3 Claims, 1 Drawing Sheet

SUN SHADE UMBRELLA MOUNT FOR A CHAIR BACK

BACKGROUND OF THE INVENTION

1. Field of the Invention

This invention relates to a sun shade umbrella and more particularly to a frame and support for attaching and supporting an umbrella on a chair back.

Because of their relatively large diameter when expanded, a sun shade umbrella requires some means of supporting it in an upright position, preferably maintained in shading relation with respect to the user, particularly when seated.

This invention provides a device for attachment to the back of a chair, whether it be outdoor furniture, a boat or tractor seat in which the umbrella and its support may be quickly attached to or removed from a chair back.

1. Description of the Prior Art

The prior art generally discloses clamping members which grip a tubular chair arm or chair back for supporting an umbrella shaft.

The most pertinent patent is believed to be U.S. Pat. No. 4,789,200 which discloses a pair of pipe clamps connected in vertically spaced relation to a chair back for gripping, in supporting relation, an open end conduit which slidably receives vertically the shank of an umbrella. A clip pin selectively engaged with one of a plurality of transverse holes through the conduit adjustably supports the umbrella relative to the position of the chair.

This invention is distinctive over this patent by providing an umbrella supporting frame removably connected with the back of a chair wherein the frame is vertically positioned relative to the normally inclined plane of a chair back so that the umbrella shank may be supported in an upright position.

SUMMARY OF THE INVENTION

An upright generally planar rectangular frame vertically supports an elongated sleeve slidably receiving an umbrella shank is removably mounted on the inclined back of a chair by J-shaped hooks, supporting the umbrella frame, secured to the upper portion of the chair back by a planar mounting member. The depending end portion of the mounting member supports horizontally disposed socket forming tubes projecting rearwardly of the chair back which telescopically receive the adjacent end portions of a pair of frame tubes for disposing the axis of the umbrella shank support sleeve substantially vertical.

The principal object of this invention is to provide an umbrella supporting frame which is easily connected to and removed from a chair back for supporting a sun shade umbrella in a selected position relative to the occupant of a chair.

DESCRIPTION OF THE PREFERRED EMBODIMENTS

Figure 1:
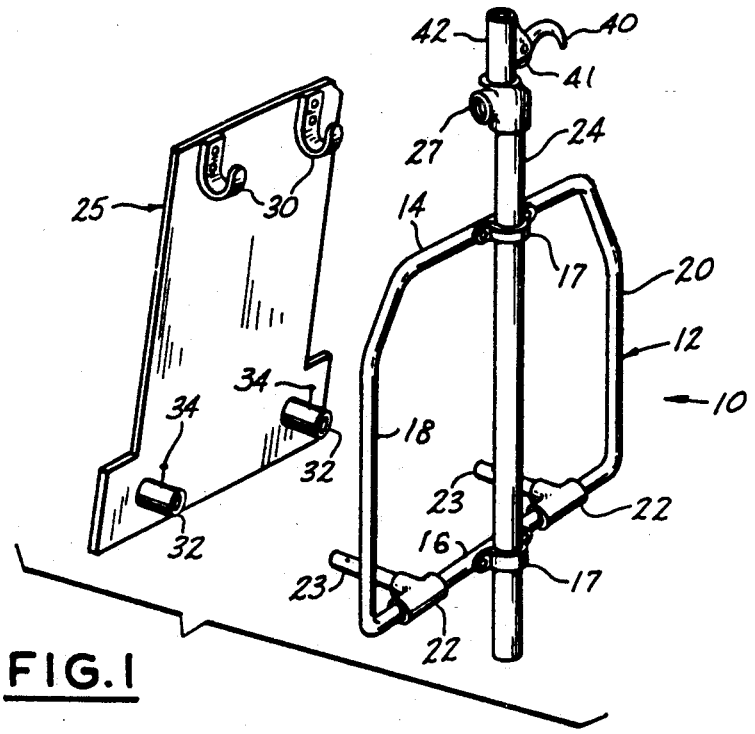
FIG. 1 is an exploded perspective view of an umbrella support frame and its chair back attaching plate; and, FIG. 2 is a perspective view, similar to FIG. 1, illustrating the relative position of a sun shade umbrella supported by the umbrella frame when attached to a chair back.
Figure 2:
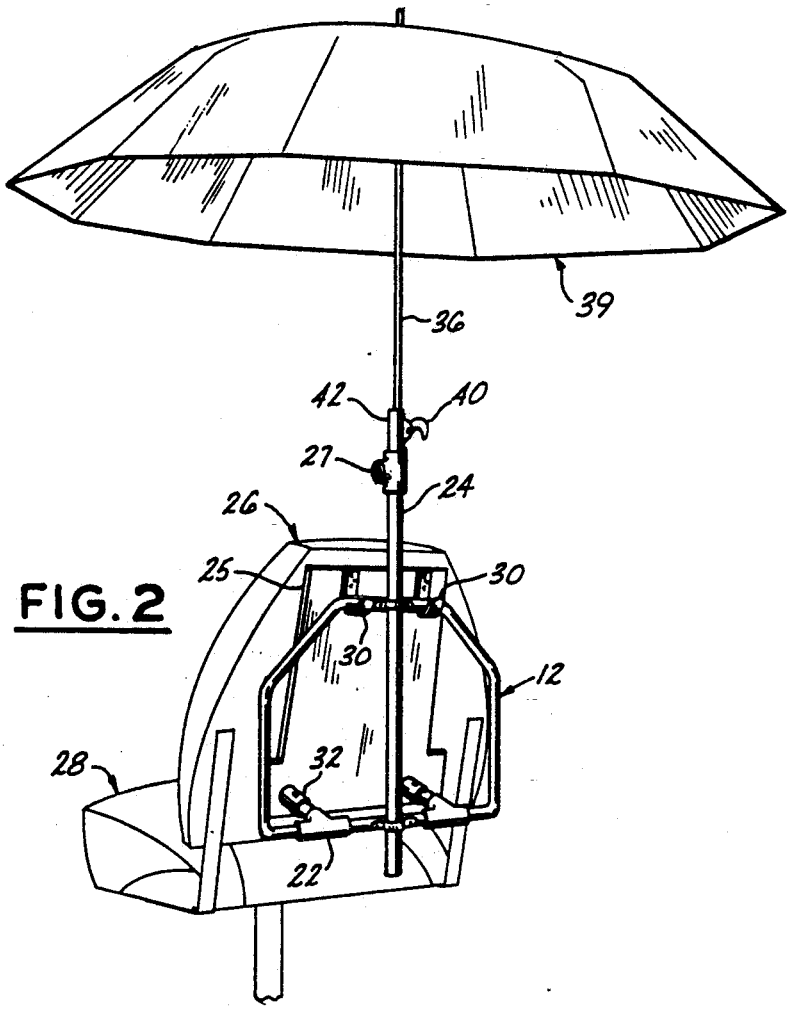

Like characters of reference designate like parts in those figures of the drawings in which they occur.

In the drawings:

The reference numeral 10 indicates the umbrella supporting device, as a whole, comprising an upright generally rectangular open frame means 12 preferably formed from plastic material having a top rail 14 and a horizontal bottom rail 16 integrally joined with uprights 18 and 20.

The respective end portions of the bottom rail 16 are provided with a pair of tees 22 respectively supporting laterally projecting parallel tubes forming legs 23 for the purpose presently explained.

An umbrella support means comprising an elongated sleeve 24 vertically spans and is secured to the frame top and bottom rails 14 and 16, as by pipe clamps 17, opposite the legs 23 for supporting an umbrella as presently explained.

A third tee 27 may be axially secured to the top end portion of the sleeve 24 for supporting a small motor driven fan, not shown.

The reference numeral 25 indicates a generally rectangular planar mounting plate secured, as by bolts or screws, to the rearward, normally inclined, surface of a seat back 26, such as a conventional boat seat 28. The mounting plate 25 is provided at its upper edge portion with a pair of laterally spaced upwardly open J-shaped hooks 30 for receiving and supporting the top rail 14 of the umbrella frame 12.

The bottom portion of the mounting plate is provided with a pair of short horizontally disposed parallel tube means forming sockets 32 projecting rearwardly of the seat which cooperatively receive in telescoping relation, the adjacent end portions of the frame legs 23. The legs 23 are secured in the sockets 32 by pins 34 entering aligned transverse bores.

As shown by FIG. 1, when the frame 12 is mounted on the mounting plate 25 the umbrella shank supporting sleeve 24 is positioned substantially vertical and cooperatively receives in telescoping relation the shank 36 of a conventional sun shade umbrella 38 when placed therein.

The umbrella 38 is adjustably supported above the frame 12 and chair occupant by a manually moved cam locking lever 40, having a cam surface 41, pivotally supported for vertical pivoting movement by a split sleeve 42 axially mounted on the sleeve 24 and surrounding a peripheral portion of the umbrella shank 36. Obviously the split sleeve 42 may be formed integral with the support sleeve 24, if desired.

The umbrella may be readily removed from the sleeve 24 by manually releasing the cam lever 40 and lifting the umbrella shank 36 out of the sleeve. The umbrella mounting frame 12 may be easily removed from the seat 28 by removing the pins 34 and manually lifting the frame 12 off the J-shaped hooks 30.

Obviously the invention is susceptible to changes or alterations without defeating its practicability. Therefore, I do not wish to be confined to the preferred embodiment shown in the drawings and described herein.

I claim:

1. An umbrella support for a chair having a back characterized by an inclined planar rearward surface, comprising:

an open frame means disposed in a vertical plane, said frame means comprising an endless rod-like member having a horizontal top rail and having a leg projecting laterally from its lower portion;

elongated sleeve means vertically supported by said frame means for telescopically receiving the shank of an umbrella;

means secured to said chair back rearward surface for removably supporting said frame means in a vertical plane;

said secured means comprising:

upwardly open hooks means near the upper limit of the chair back for supporting the frame top rail;

tube means forming a socket telescopically securing the end portion of said leg opposite the frame; and, cam lever means supported by said sleeve means for gripping the umbrella shaft.

2. The umbrella support according to claim 1 in which said sleeve means comprises:

an elongated sleeve spanning and extending beyond said frame; and, means for fastening said sleeve to the upper and lower limits of said frame.

3. The umbrella support according to claim 2 in which said cam means comprises:

an outwardly projecting lever pivotally supported by the wall of said sleeve for vertical pivoting movement about a horizontal axis, one end of said lever having a cam surface projecting into said sleeve and moving toward and away from the vertical axis of the sleeve when the other end portion of said lever is manually moved vertically.

* * * * *